US005518134A

United States Patent [19]

Liu

[11] Patent Number: 5,518,134

[45] Date of Patent: May 21, 1996

[54] PIN LOCK LIDDED CUP

[76] Inventor: Chin C. Liu, No. 25, Lane 16, Tung Hsing St., Shu Lin Town, Taipei Hsien, Taiwan

[21] Appl. No.: 324,081

[22] Filed: Oct. 14, 1994

[51] Int. Cl.[6] ..... B65D 43/18

[52] U.S. Cl. ..... 220/336; 220/710.5; 220/703

[58] Field of Search ..... 220/262, 263, 220/264, 336, 703, 710.5, 711, 714, 715, 726; 222/465.1, 469, 520

[56] References Cited

U.S. PATENT DOCUMENTS

| | | | |
|---|---|---|---|
| 1,230,623 | 6/1917 | Teven | 220/336 |
| 1,634,029 | 6/1927 | Korkames | 220/336 X |
| 1,998,373 | 4/1935 | Love | 220/336 |
| 2,552,397 | 8/1951 | Bretney | 220/336 X |
| 4,165,013 | 8/1979 | Lutz | 220/336 X |
| 4,712,704 | 12/1987 | Ramsey et al. | 220/336 X |
| 5,082,134 | 1/1992 | Ramsey | 220/711 |
| 5,175,918 | 1/1993 | Christopher | 220/336 X |

*Primary Examiner*—Allan N. Shoap
*Assistant Examiner*—Nathan Newhouse
*Attorney, Agent, or Firm*—Pro-Techtor International

[57] ABSTRACT

A lidded cup which includes a rotating pivot at one side of the lid, and a matching pivot at one side of the lid, and a matching hollow sleeve handle at the corresponding side of the cup to provide the lid-cup assembly. A matching toothed edge at both the rotating pivot and the inner sleeve handle are designed to allow the lid to rise and slide open. The lid may also return and automatically shut by its own weight through the design of eccentric tilted devices on the lid's pivot and the handle's tilted inner sleeve.

8 Claims, 16 Drawing Sheets

PIN LOCK LIDDED CUP

BACKGROUND OF THE INVENTION

1. Field of the Invention

The present invention relates to an improved cup structure, and in particular, is a lidded cup to allow simple opening and closing of the cup lid.

2. Description of the Prior Art

The conventional lidded cups are designed with separate cups and lids; thus, to open and close the lid, both hands have to be used, which makes the cup awkward to operate, and increase the possibility of damaging or losing the lid.

SUMMARY OF THE INVENTION

The present invention is a lidded cup which comprises a rotating pivot at one side of the lid, and a matching pivot at one side of the lid, and a matching hollow sleeve handle at the corresponding side of the cup to provide the lid-cup assembly. A matching toothed edge at both the rotating pivot and the inner sleeve handle are designed to allow the lid to rise and slide open. The lid may also return and automatically shut by its own weight through the design of eccentric tilted devices on the lid's pivot and the handle's tilted inner sleeve.

Another purpose of the present invention is to offer a lidded cup with a lid handle located between the lid and cup. A shaft of the handle fits into the rotating pivot, and the handle ear is connected to a pushing rod to move the lid.

Another purpose of the present invention is to offer a lidded cup with an eccentric indented groove and a tilted pin between the lid and the cup, whereby the lid may be opened with slight pressure applied by a single hand. As the pressure is released, the lid will return to its original closed position. The lid with a connected handle grip allows the lid to open and close by simple operation of the cup handle.

BRIEF DESCRIPTION OF THE DRAWINGS

The drawings disclose illustrative embodiments of the present invention which serves to exemplify the various advantages and objects hereof, and are as follows.

DETAILED DESCRIPTION OF THE PREFERRED EMBODIMENTS

Figure 1:
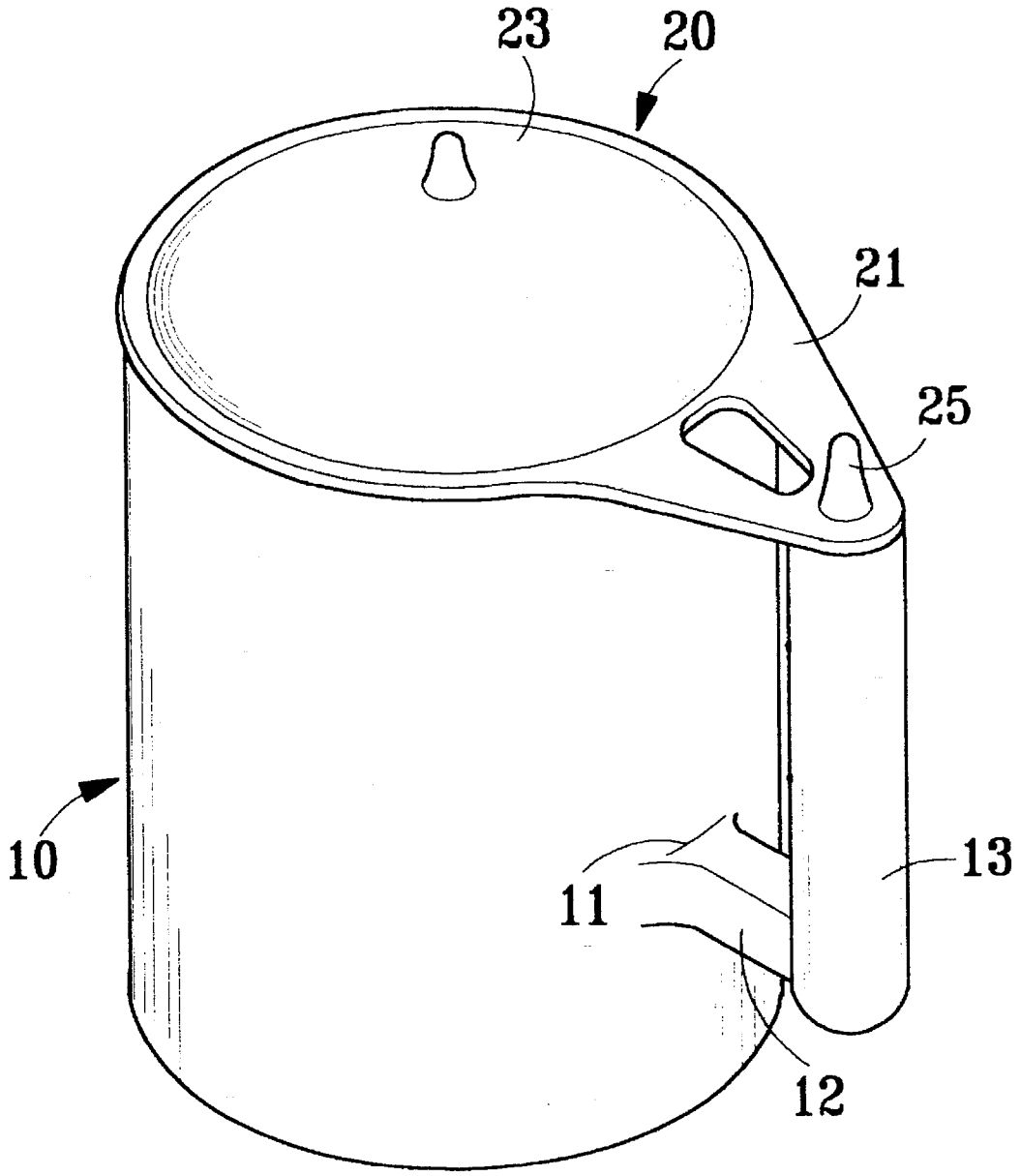
FIG. 1 is a perspective view of the first embodiment of the present invention.
Figure 2:
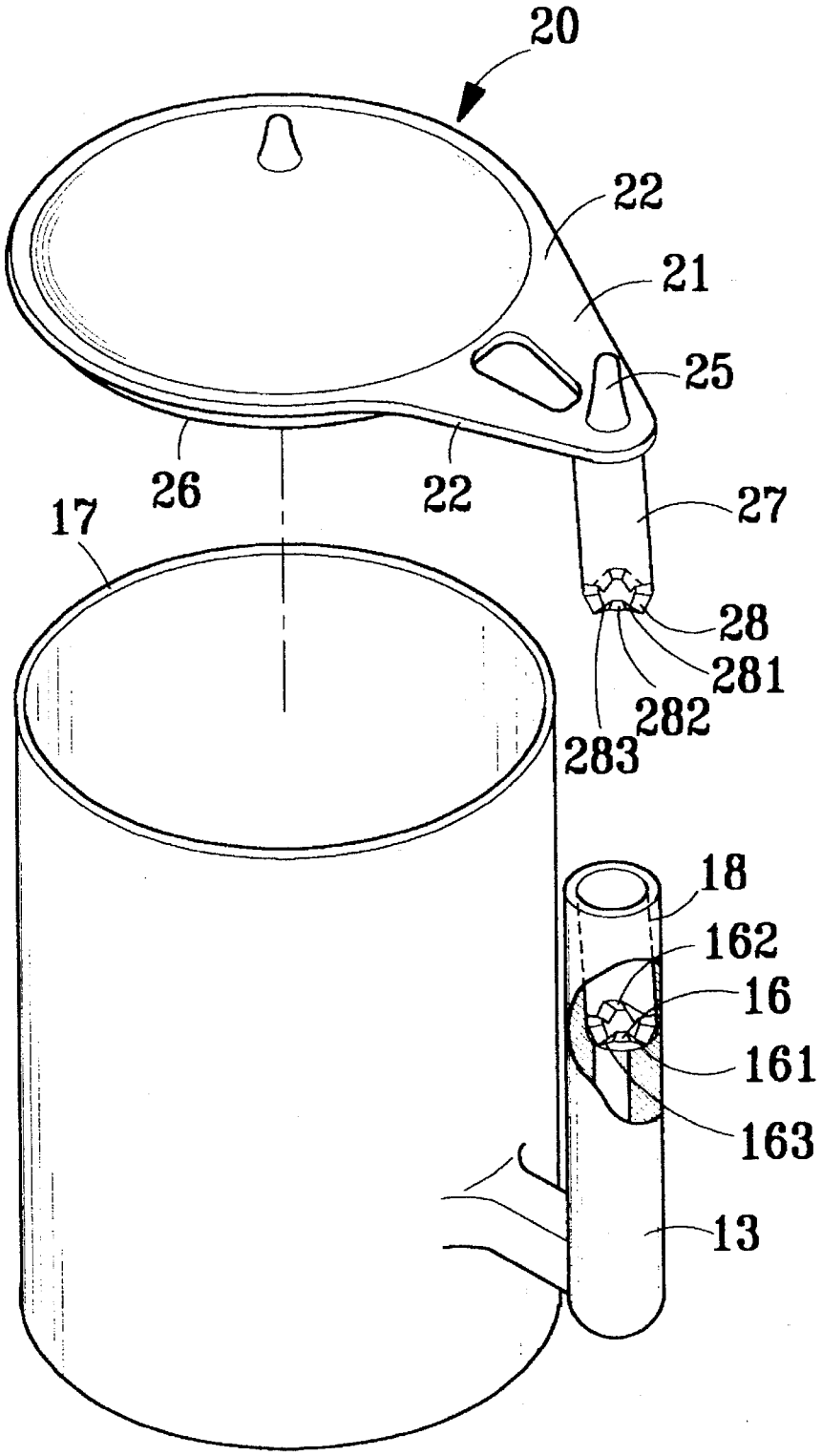
FIG. 2 is an exploded view of the first embodiment of the present invention.
Figure 3:
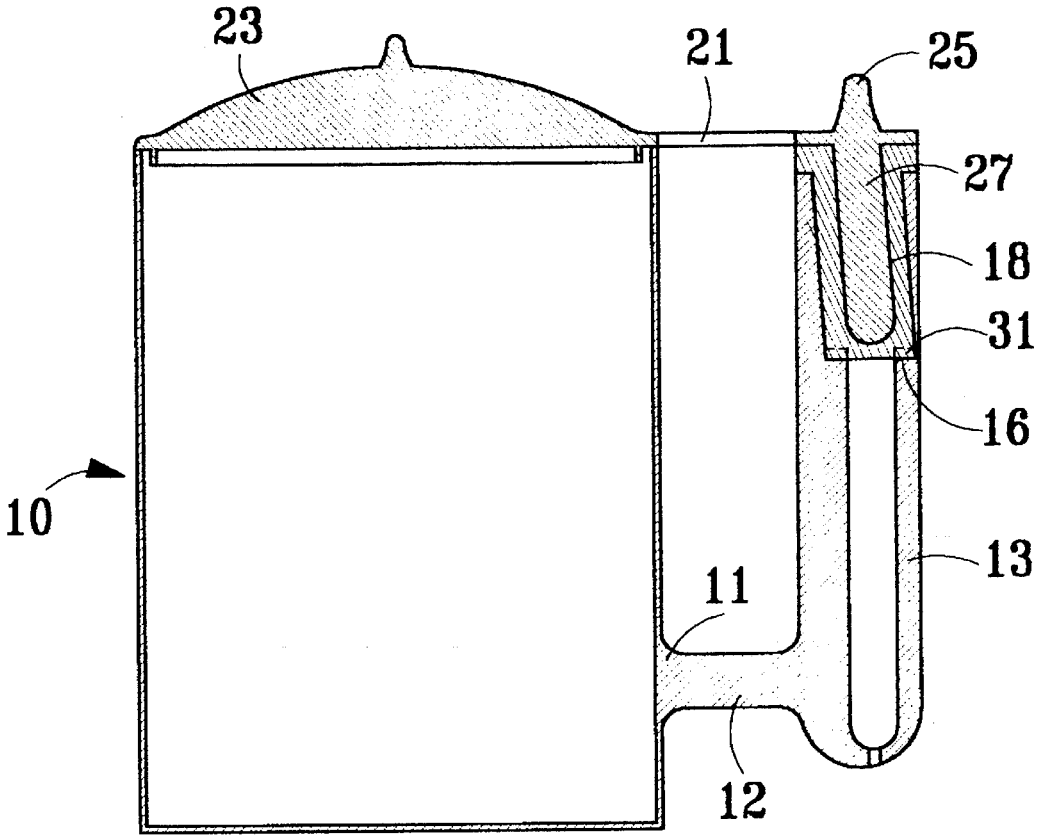
FIG. 3 is a cross section view of the first embodiment of the present invention.
Figure 4:
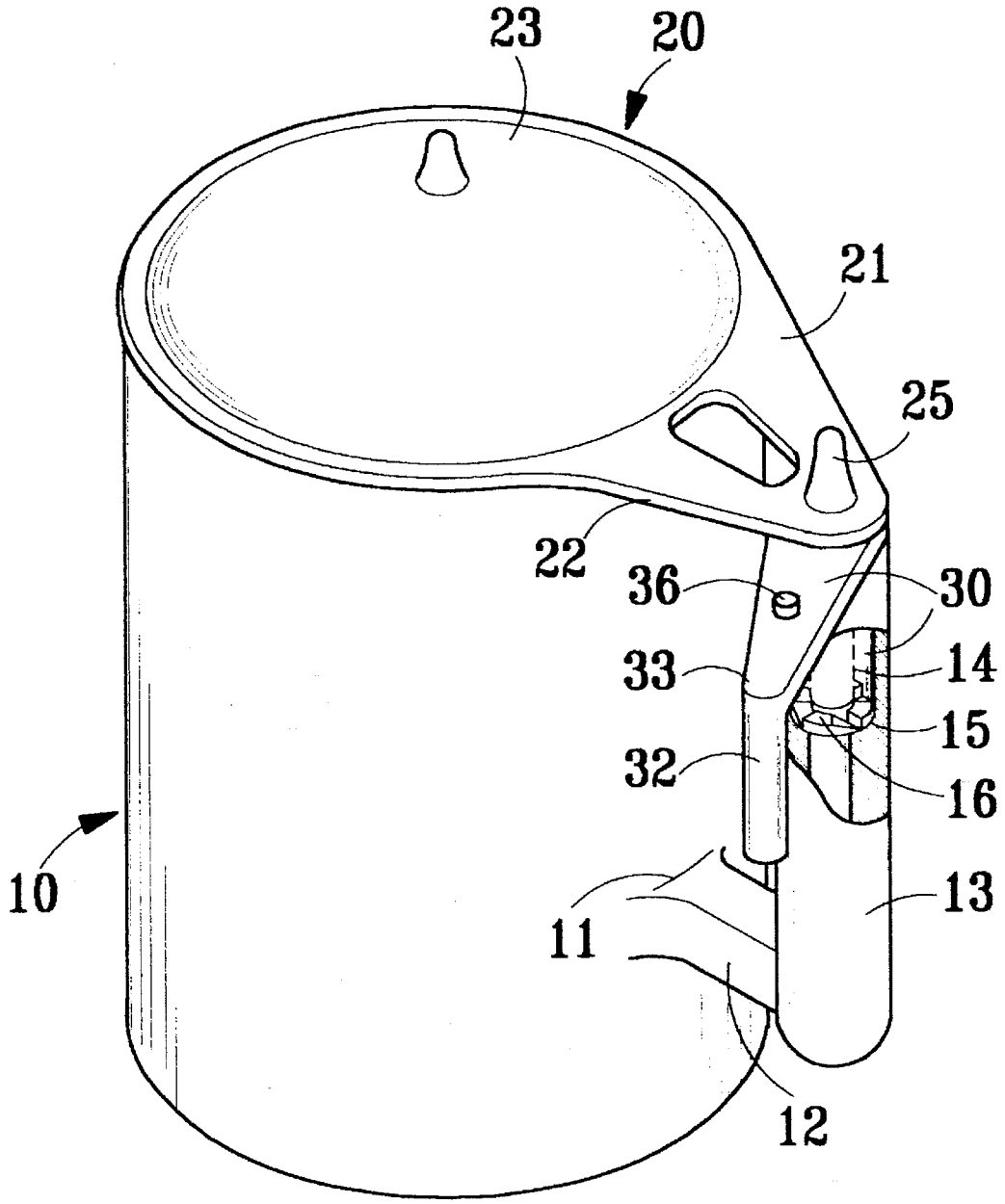
FIG. 4 is a perspective view of the second embodiment of the present invention.
Figure 5:
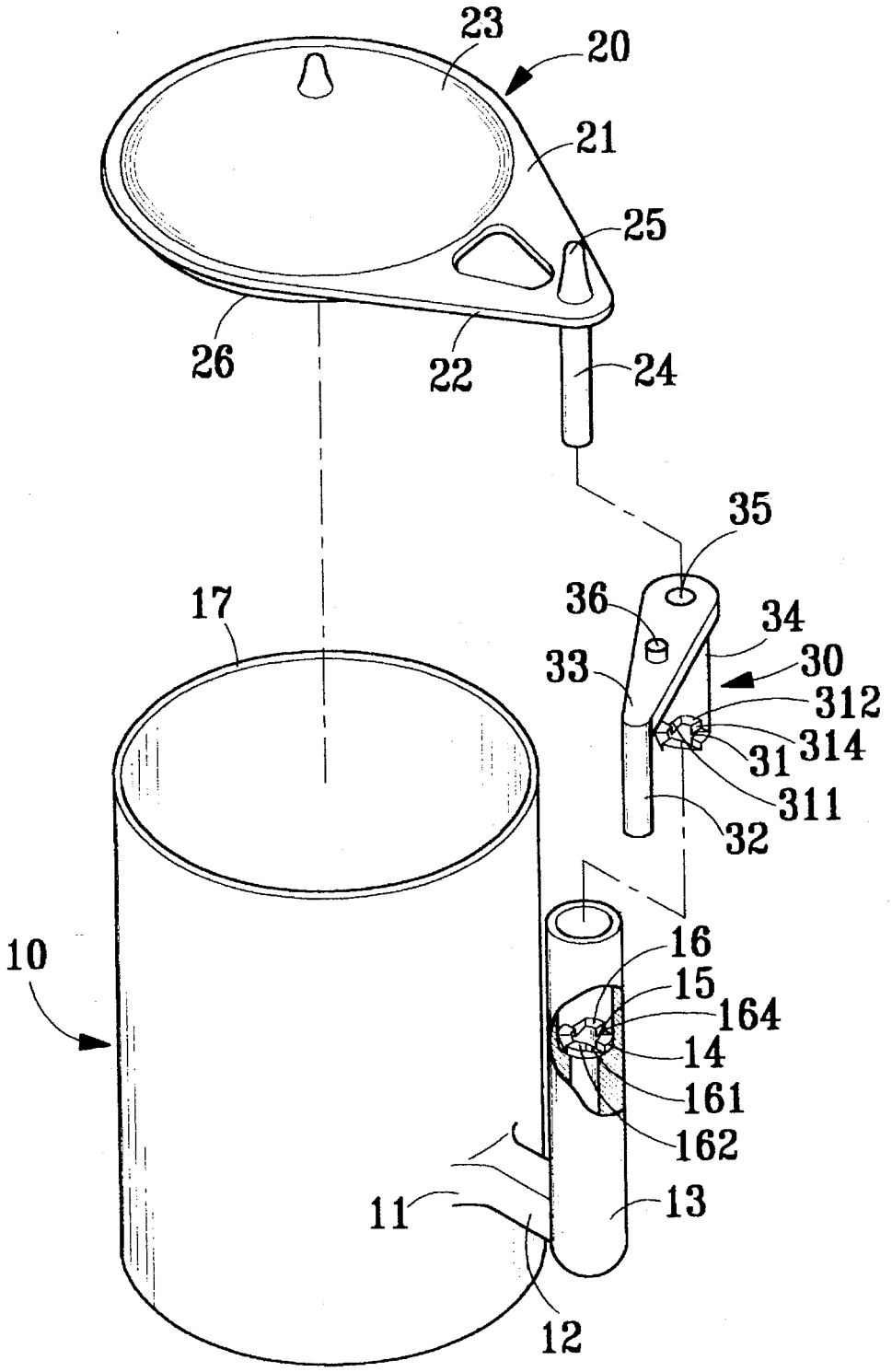
FIG. 5 is an exploded view of the second embodiment of the present invention.
Figure 6:
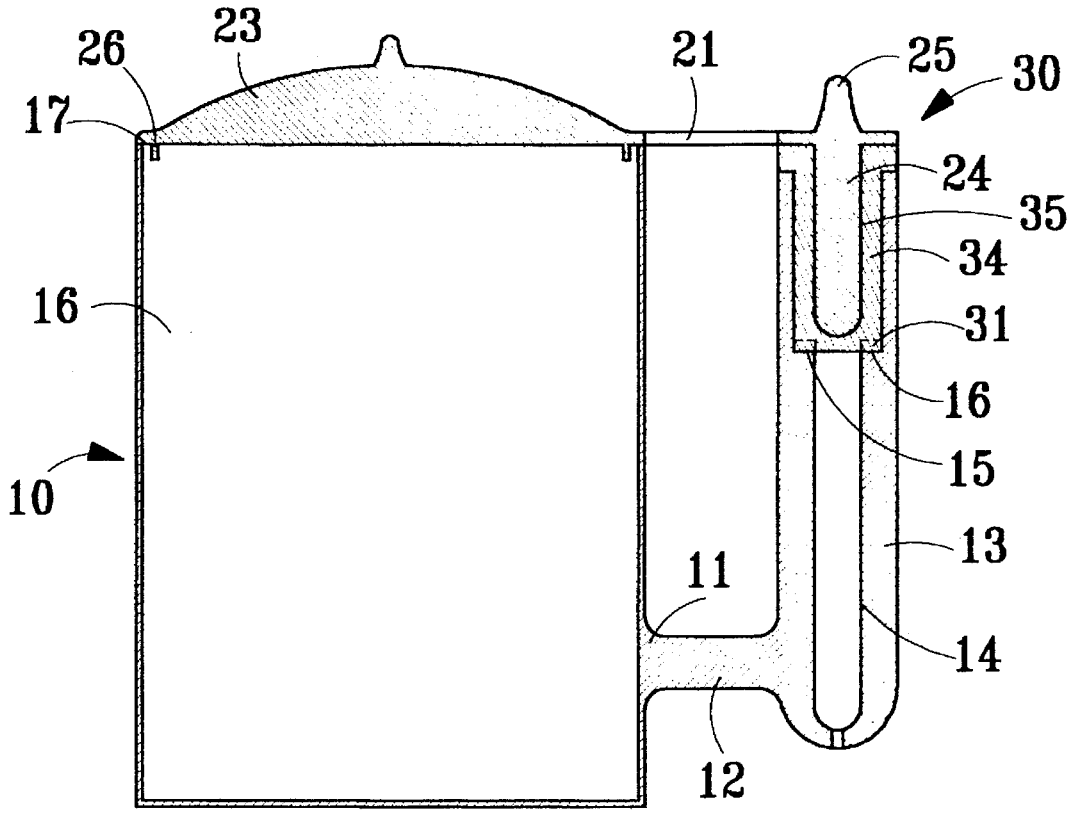
FIG. 6 is a cross section view of the second embodiment of the present invention.

Please refer to FIGS. 1 to 3, which illustrate the first embodiment of the present invention of the lidded cup. A toothed edge of the bottom of an angled cavity in the hollow handle meshes with the toothed edge of the rotating pivot. This allows the cup lid to first rise, then slide open when moved either right or left. The assembly comprises a cup body 10 and a matching lid 20, with a hollow handle 13 affixed to the cup body 10. A horizontal segment 12 of the handle 13 is affixed to a lower end 11 of the cup body 10. The hollow handle 13 is designed with teeth 16 at the bottom of an angled cavity 18. Each tooth 16 includes a first slanted surface 161, a flat surface 162, and a second slanted surface 16. The cup lid 20 comprises a lid 23, an extension piece 21 and an eccentric rotating pivot 27. The extension piece 21 extends horizontally from the edge of cup lid 23. A terminal end of the extension piece 21 is connected to the top of the eccentric rotating pivot 27, which has teeth 28 located at the bottom end thereof. Each of the teeth 28 has a flat surface 282 and first and second slanted surfaces 281 and 283. The teeth 28 of the pivot 27 are designed to mesh with the teeth 16 on the bottom of the angled cavity 18 when the eccentric rotating pivot 27 is inserted into the angled cavity 18 of the hollow handle 13. When a user's thumb pushes the side 22 of cup lid 20, the cup lid 20 will follow the slanted surface 161 or 163 on the inner handle 13 to raise the cup lid 20. The flat surfaces 162 allow the cup lid 20 slide open. The titled angle design of the eccentric rotating pivot 27 allows the cup lid 23 to automatically return to its original position on the rim of the cup body 11 when the user releases his thumb, the weight of the cup lid 20 urging it to return to its closed position.

Refer now to FIG. 4 to FIG. 8, which illustrate a second embodiment of the present invention. The assembly comprises a cup body 10, a cup lid 20 and a cup lid ear 30. A horizontal segment 12 of the handle 13 is affixed to the lower end 11 of the cup body 10. Teeth 16 are located on a step 15 in the interior 14 of the handle 13. Each tooth comprises a slanted surface 161, a fiat surface 162 and a vertical surface 164. The lid ear 30 comprises a pushing rod 32, a connecting piece 33 and a rotating pivot 34. The bottom of the rotating pivot 34 includes teeth 31. Each tooth 31 of the pivot 34 includes a slanted surface 311, a flat surface 312, and a vertical surface 314 which mesh with the teeth 16 in handle 13. The middle portion of the connecting piece 33 includes a projection 36. The cup lid 20 includes a cup body 23, an extension piece 21 and a rotating shaft 24. The rotating shaft 24 plugs into the hole 35 of hollow rotating shaft 34 of cup lid ear 30. A short rod 25 is included on the top of the rotating shaft 24 to allow cup lid 20 to be pulled from the hole 35 of cup lid ear 30.

Figure 7:
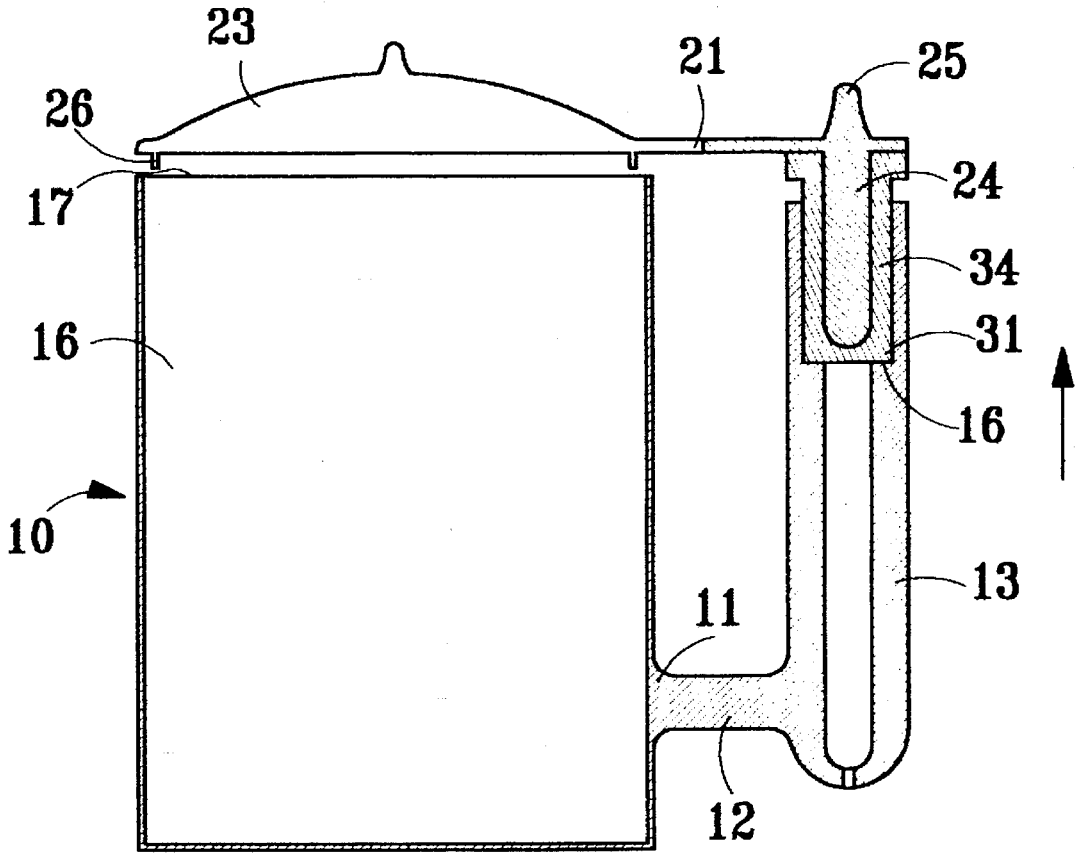
FIG. 7 is a cross section view of the second embodiment with the lid raised.
Figure 8:
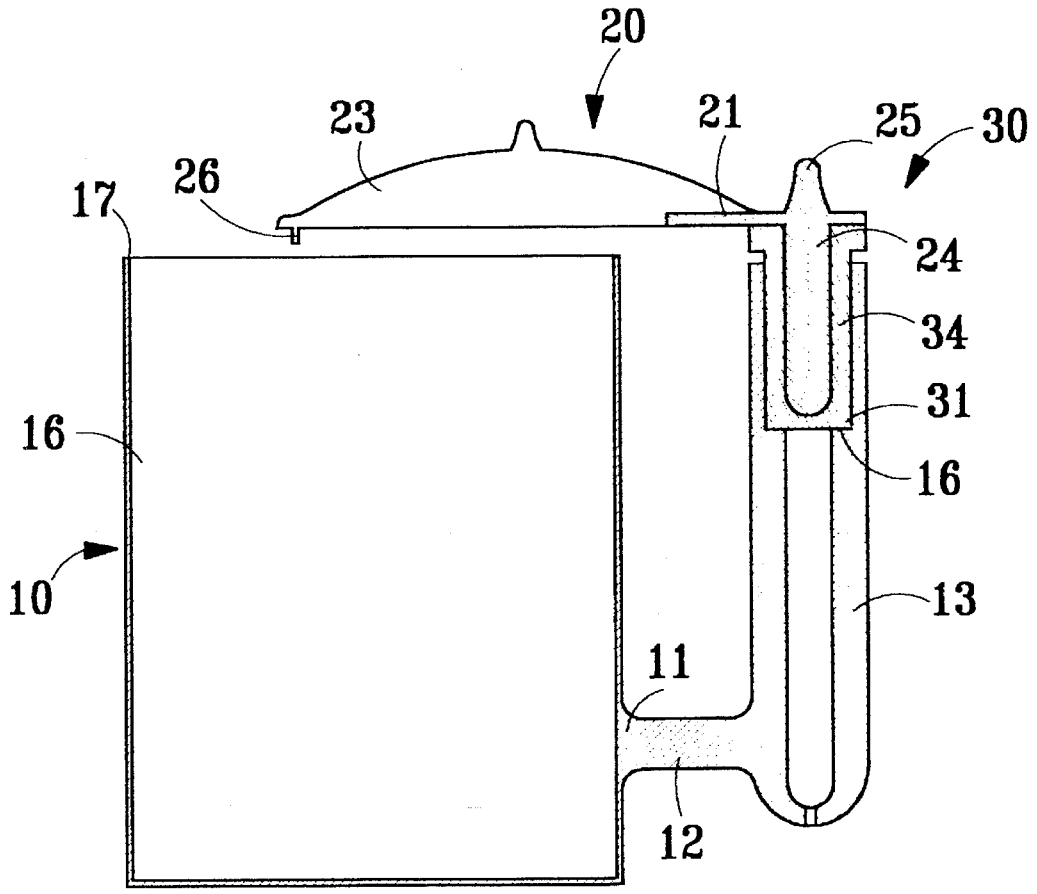
FIG. 8 is a cross section view of the second embodiment after the rotation motion is completed.

To operate the cup, a user grasps the handle 13, and pushes pushing rod 32 on the cup lid ear 30 toward the cup body 10 with his thumb. The projection 36 on the connecting piece 33 contacts the side 22 of the cup lid 20 extension piece 21. The slanted surface 161 on inner tooth 16 of handle 13 allows the cup lid ear 30 to rise by means of slant surface 311 on the rotating shaft 34 sliding across the slant surface 161. The cup lid 20 will also rise by the motion of lid ear 30 which is demonstrated in FIGS. 7 and 8. In FIG. 7, the lid covers the cup rim 17. As shown in FIG. 8, the cup lid ear 30 moves the lid 20 until the projection 36 contacts the side 22 of lid 20. This causes the lid 20 to rise as it pivots, revealing the opening of the cup body 10.

Figure 9:
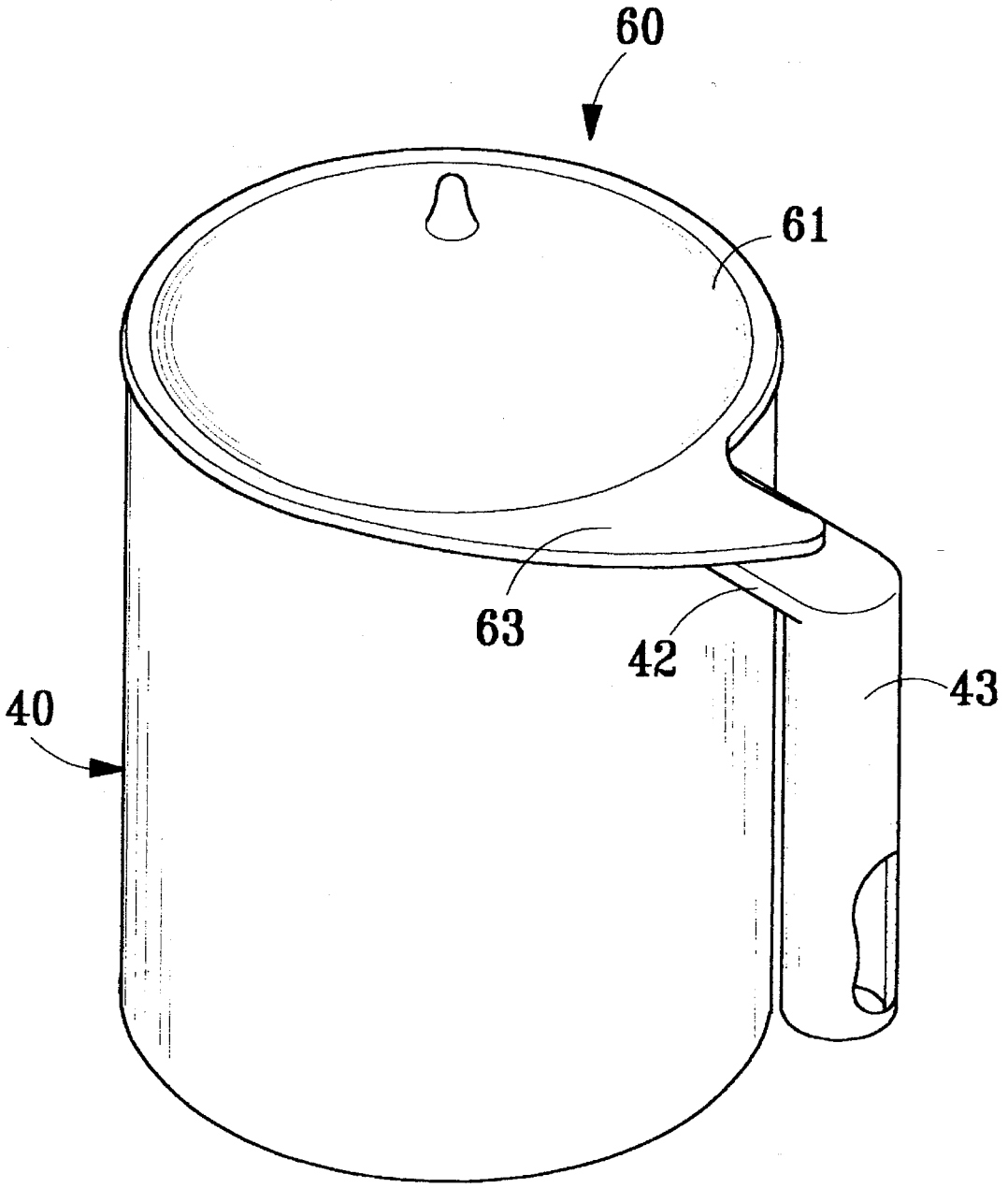
FIG. 9 is a perspective view of the third embodiment of the present invention.
Figure 10:
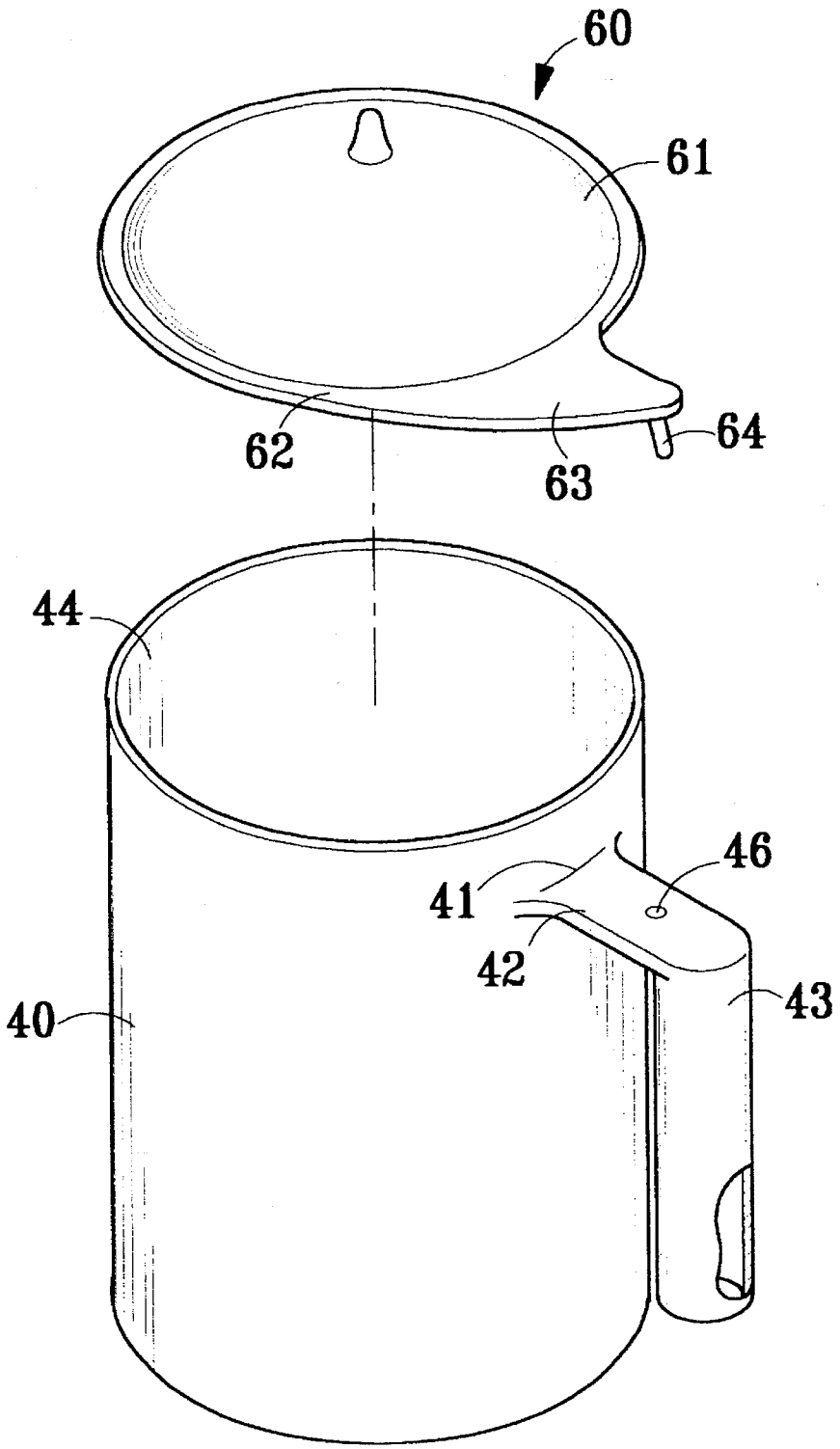
FIG. 10 is an exploded view of the third embodiment of the present invention.
Figure 11:
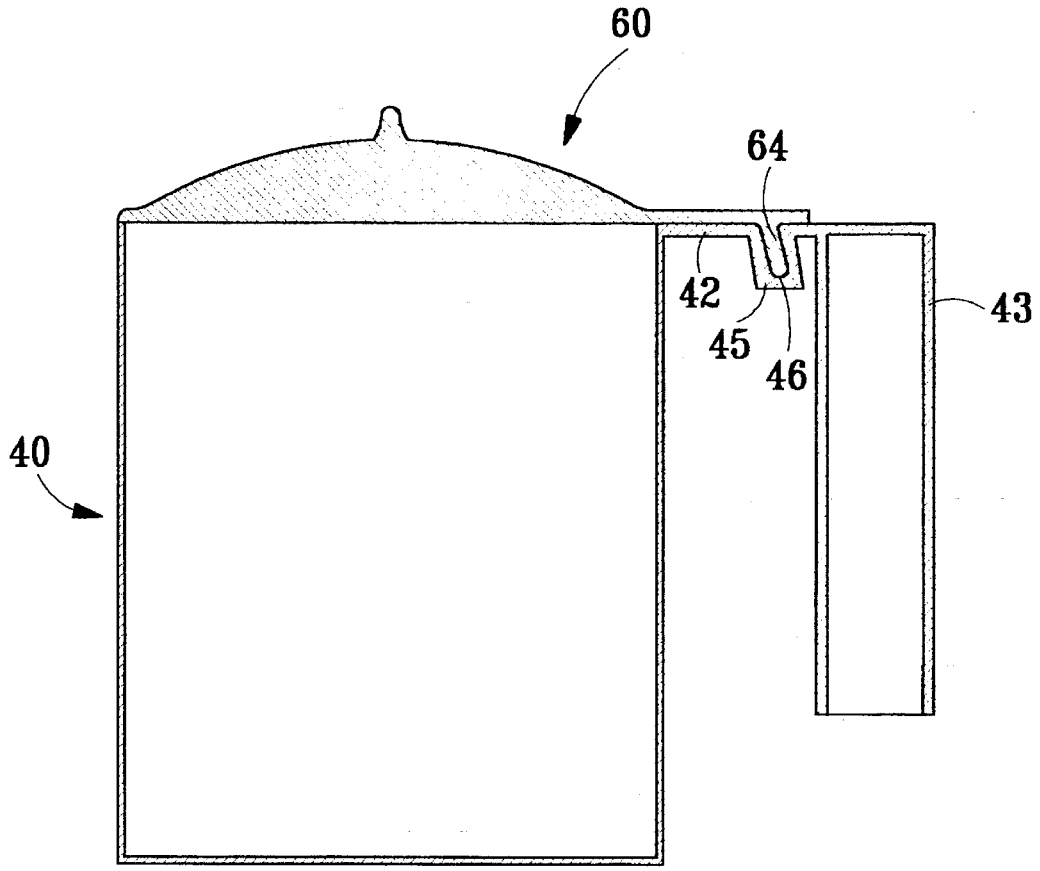
FIG. 11 is a cross section view of the third embodiment of the present invention.
Figure 12:
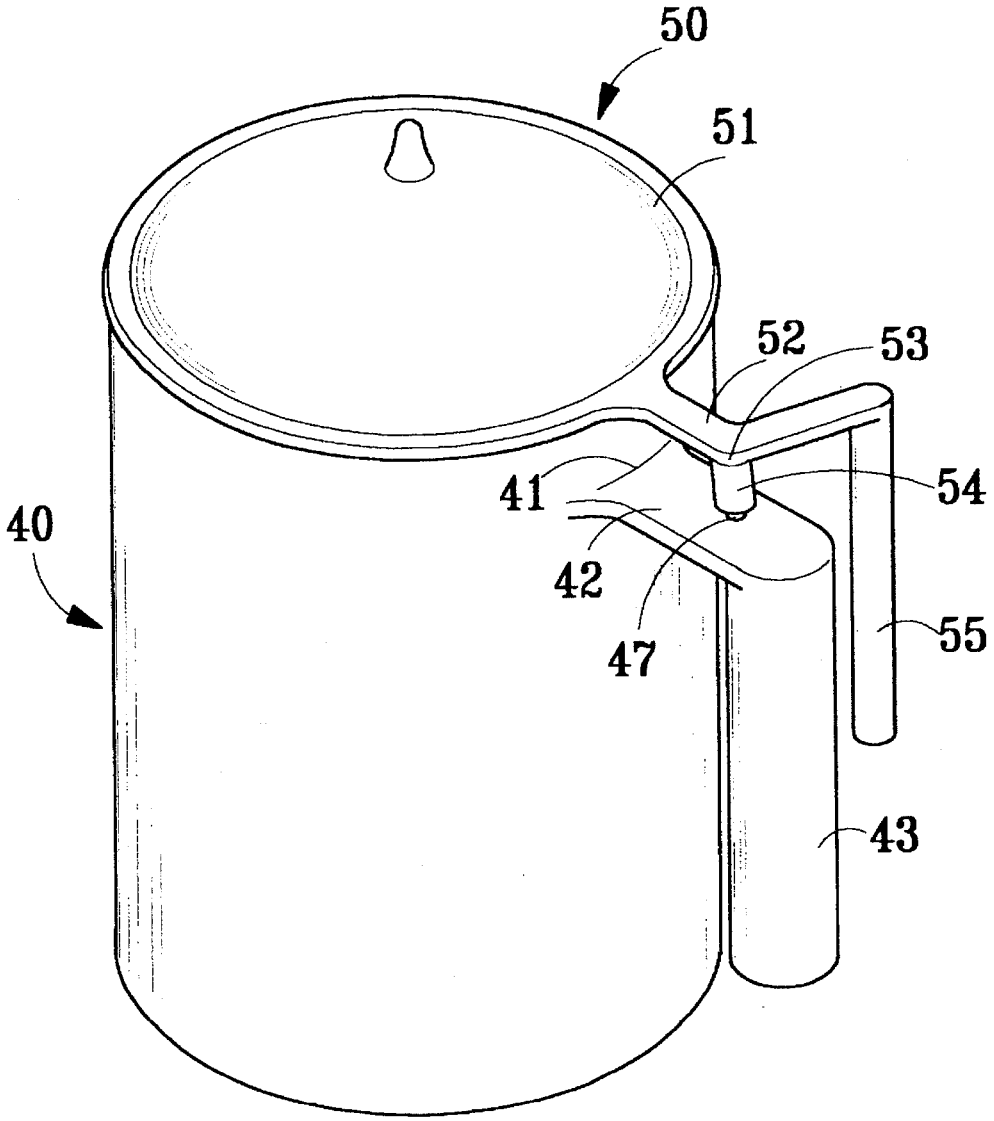
FIG. 12 is a perspective view of the fourth embodiment of the present invention.
Figure 13:
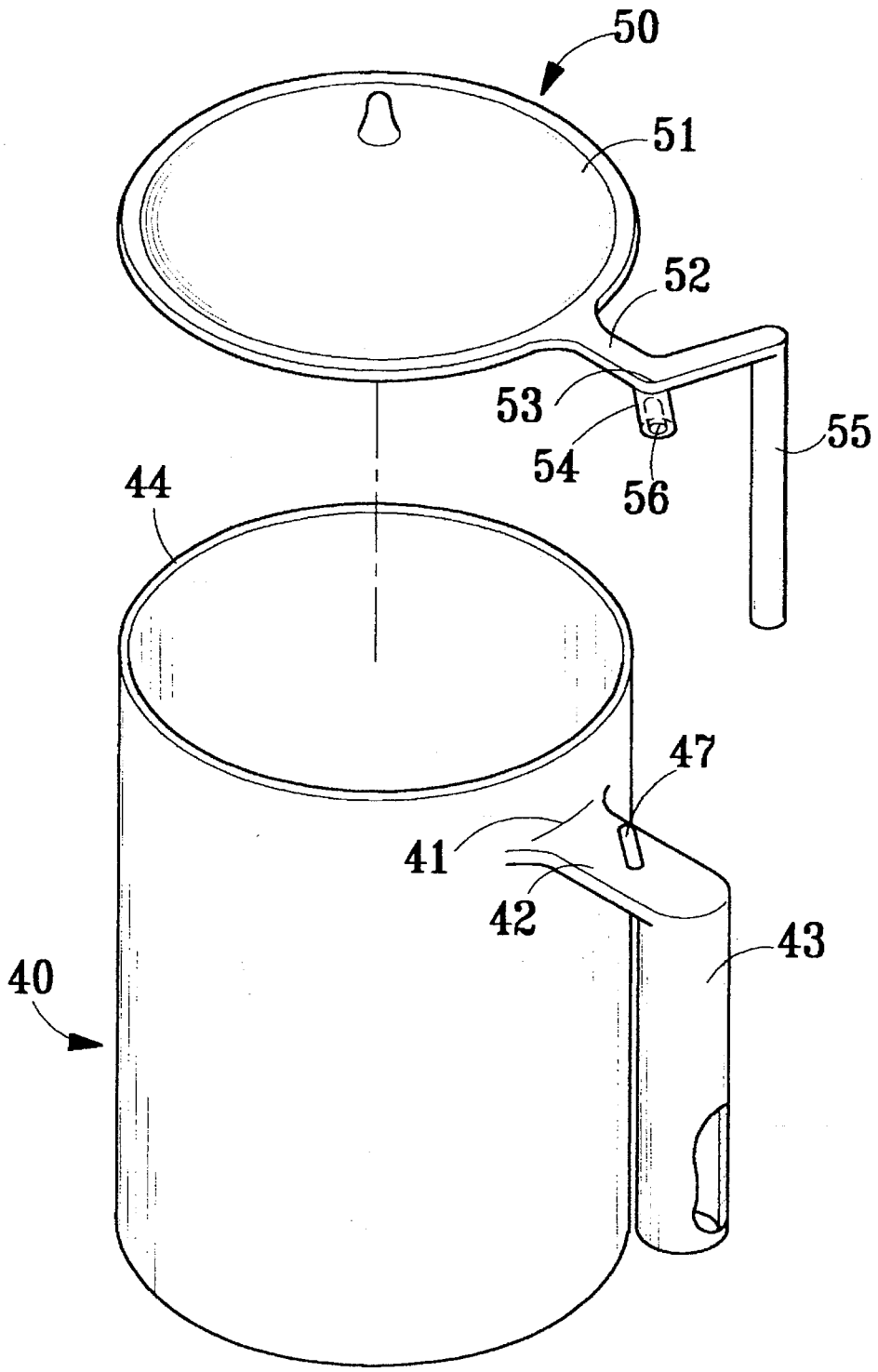
FIG. 13 is an exploded view of the fourth embodiment of the present invention.
Figure 14:
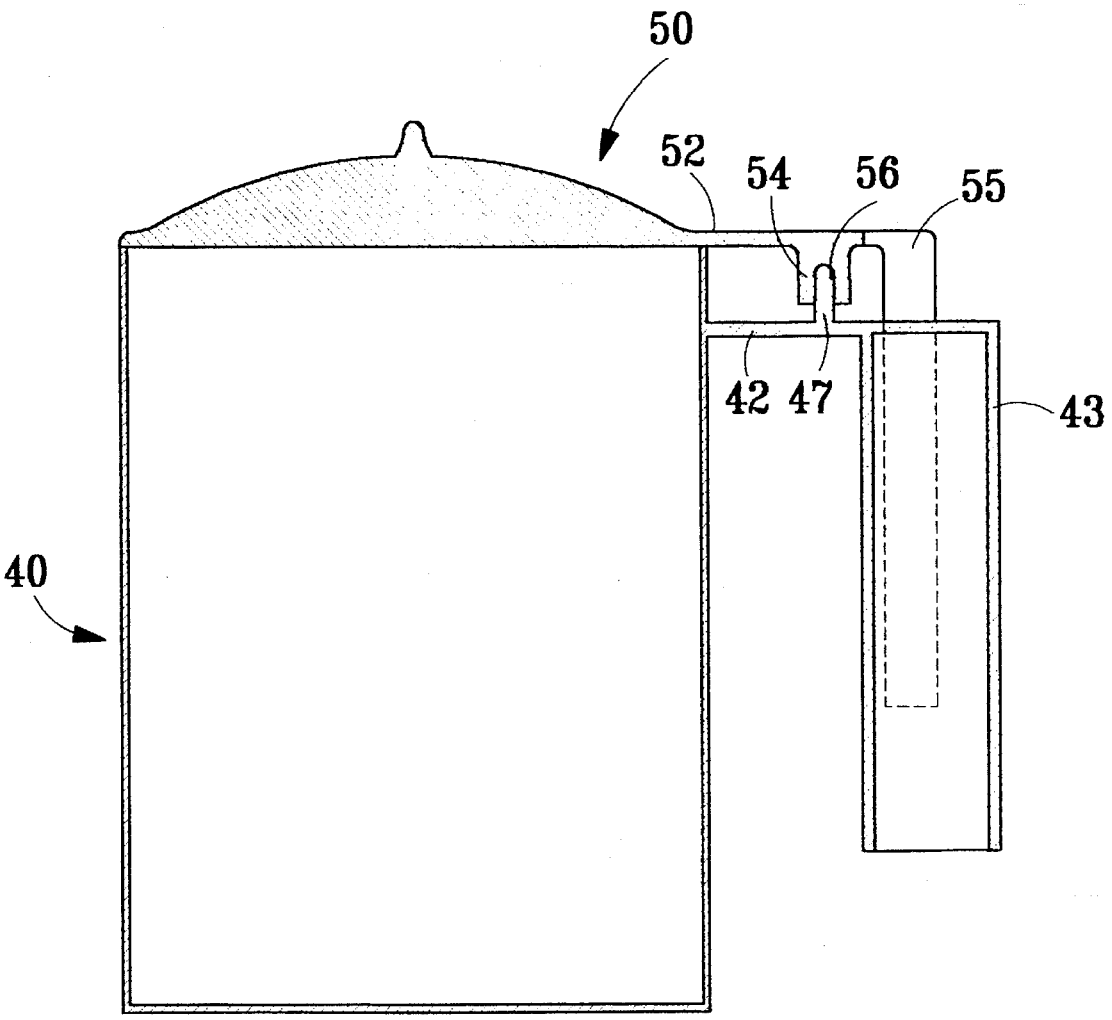
FIG. 14 is a cross section view of the fourth embodiment of the present invention.

Refer now to FIG. 9 to FIG. 11 which illustrate the third embodiment of the present invention. The third embodiment comprises a cup lid 60 and a cup body 40. A horizontal segment 42 of the handle 43 extends from an upper end 41 of the cup body 40. A tilted rotating stud 64 protrudes from an underside of the extension piece 42. The cup lid 60 comprises a cup lid body 61, wherein the edge 62 of the cup lid body 61 includes a curved extension that forms a pushing piece 63. At the bottom end of the pushing piece 63 is the eccentric tilted stud 64. The cup body 40 is connected to the tilted stud 64 on cup lid 60 by an eccentric indent 46. When a user pushes the side of the pushing piece 63 on cup lid 60 with his thumb, the cup lid 60 will rotate by means of the eccentric indent 46 on cup body 40 and the matching titled stud 64. As the pressure is released, the lid will return to its original position.

Refer now to FIG. 12 to FIG. 16, illustrating a fourth embodiment of the present invention. The unit comprises a cup lid 50 and a cup body 40. An extension piece 42 of the handle 43 extends horizontally from an upper end 41 of cup body 40. A tilted stud 47 protrudes from a top side of the extension piece 42.

Figure 15:
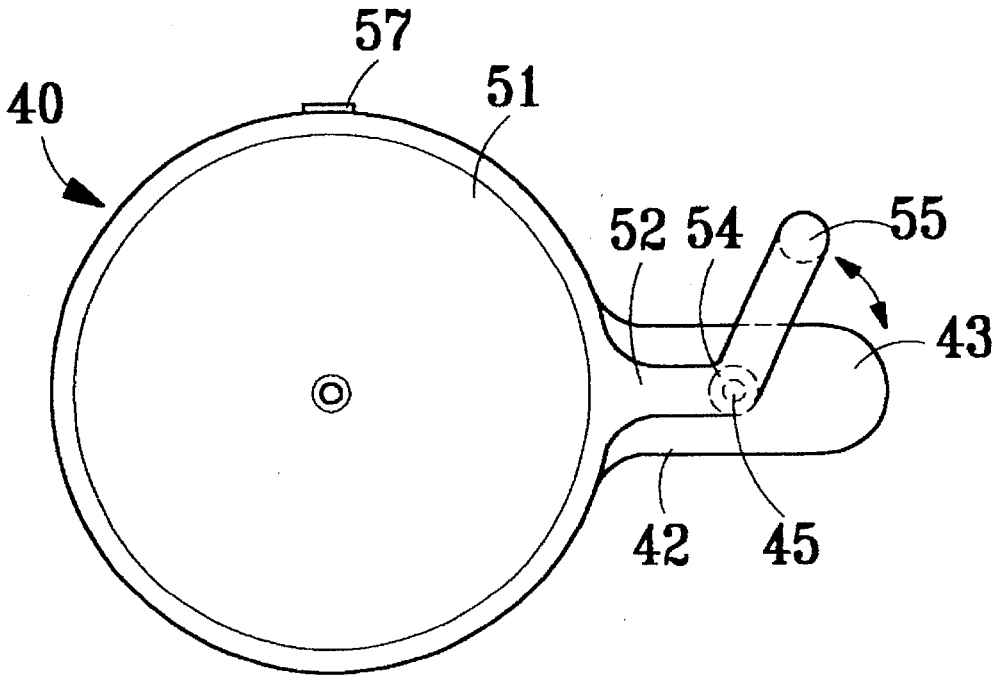
FIG. 15 is a top view of the fourth embodiment of the present invention.
Figure 16:
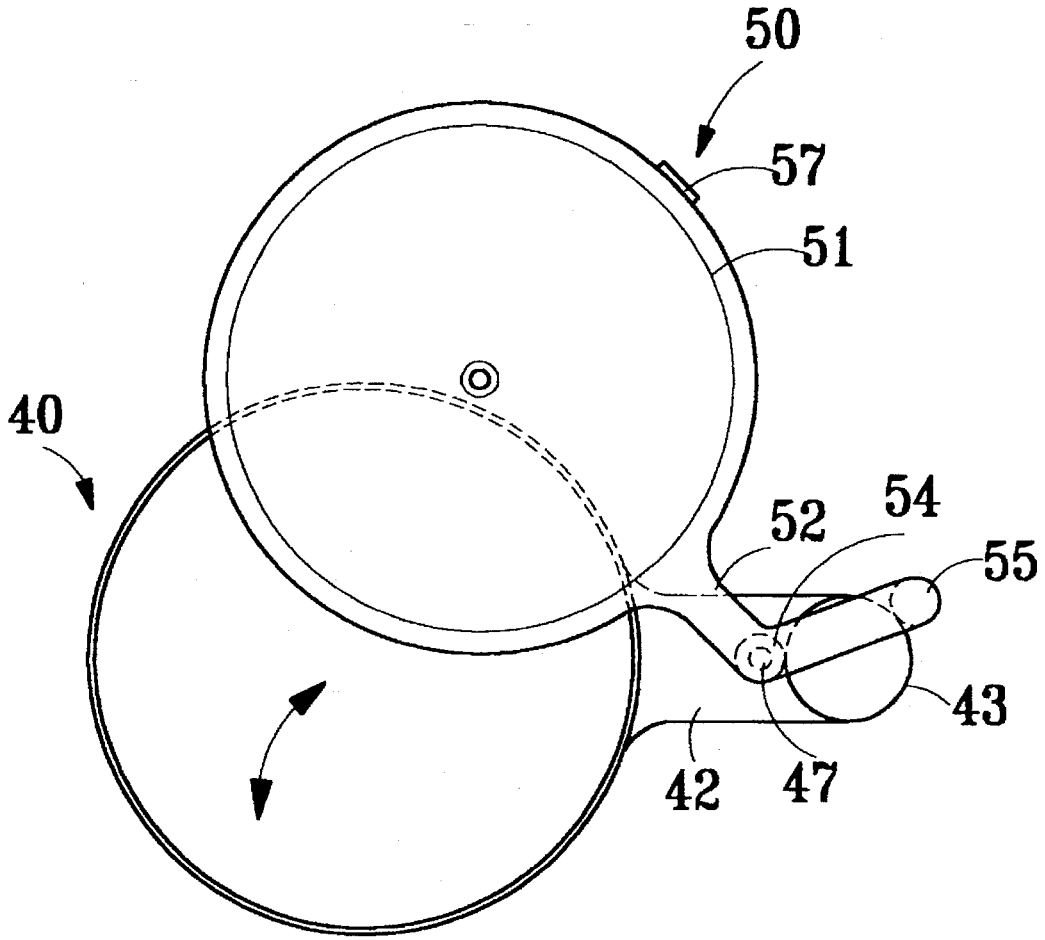
FIG. 16 is a top view of the fourth embodiment of the present invention after the lid is raised and rotated.

An "L" shaped connecting rod 52 connects the cup lid body 51 to a grip rod 55. At the turn about 53 of the "L" shaped connecting rod 52 (on the counter point of titled stud 47) a tilted rotating pivot 54 is extends from the underside of the connecting rod 52 at the angled portion 53, corresponding in location to stud 47. An eccentric indent 56 is included in the rotating pivot 54. When assembled, the tilted stud 47 on cup body 40 is placed into the eccentric indent 56 of the rotating pivot 54. To move the cup lid 50 as shown in FIG. 15 and 16, the cup lid's 50 eccentric indent 56 is rotated around the tilted stud 47 on the extension piece 42. The cup lid 50 is pushed open by the interconnected titled angle of eccentric indent 56 and titled stud 47 when the tilted stud 47 serves as the center support. When the grip rod 55 moves toward the handle 43, the cup lid 50 is opened. When the user releases pressure on the grip rod 55, the cup lid 50 returns to its original position, and is prevented from sliding past its original position by stop 57. In this manner, the cup mouth 44 is covered.

Many changes and modifications in the above described embodiment of the invention can, of course, be carried out without departing from the scope thereof. Accordingly, the invention disclosed is intended to be limited only by the scope of the appended claims.

What is claimed is:

1. A lidded cup comprising:

a cup body and a lid, with a hollow handle affixed to the cup body;

the hollow handle includes a plurality of teeth at a bottom of an angled cavity, the cup lid comprises an extension piece, and an eccentric rotating pivot that is received in the angled hollow cavity in the handle, the extension piece of the cup lid extends horizontally from an edge of the cup lid, a terminal end of the extension piece is connected to a top of the eccentric rotating pivot, the rotating pivot includes a plurality of teeth at a bottom end thereof, the teeth of the rotating pivot mesh with the teeth on the bottom of the angled cavity when the rotating pivot is inserted into the angled cavity of the hollow handle, such that;

when a user's thumb pushes a side of the cup lid, the rotating pivot rotates in the angled cavity, causing the meshed teeth to partially separate, thereby raising the cup lid and allowing it to rotate to expose a rim of the cup body, and when the user releases his thumb, the orientation of the rotating pivot causes the weight of the cup lid to automatically return the cup lid to its original closed position on the rim of the cup body.

2. The cup of claim 1 wherein:

each of said teeth includes two slanted surfaces and a flat surface.

3. The cup of claim 1 wherein:

each of said teeth includes a straight surface, a slanted surface, and a flat surface.

4. The cup of claim 1 wherein:

the cup includes a lid ear rotatably affixed to the cup handle, the lid ear comprising a pushing rod and a connecting piece with a projection; such that to operate the cup, the user grasps the handle and pushes the pushing rod on the lid ear with his thumb, thereby causing the projection on the connecting piece of the lid ear to contact the cup lid, the lid thereby being pushed open.

5. The cup of claim 4 wherein:

each of said teeth includes two slanted surfaces and a flat surface.

6. The cup of claim 4 wherein:

each of said teeth includes a straight surface, a slanted surface, and a flat surface.

7. A lidded cup comprising:

a cup lid and a cup body with a handle extending horizontally from an upper end of the cup body, with a tilted stud protruding from a top side of the handle, an "L" shaped connecting rod connects the cup lid to a grip rod; at an angled portion of the connecting rod, a tilted rotating pivot extends from an underside of the connecting rod at a position corresponding to that of the tilted stud, the rotating pivot including an indent to receive the stud; wherein to move the cup lid, a user pushes the grip rod toward the handle, thereby causing the cup lid to rotate about the stud, causing the cup lid to open, and when the user releases pressure on the grip rod, the cup lid returns to its original closed position.

8. The cup of claim 7 wherein:

the cup lid is prevented from sliding past its original closed position by a stop that extends downward from an underside of the cup lid.

* * * * *